United States Patent [19]

Off et al.

[11] 4,400,165

[45] Aug. 23, 1983

[54] GARMENT WELT FOLDER

[75] Inventors: Joseph W. A. Off, Irving; Judson H. Early, Dallas, both of Tex.

[73] Assignee: Haggar Company, Dallas, Tex.

[21] Appl. No.: 310,920

[22] Filed: Oct. 13, 1981

[51] Int. Cl.[3] ..... B65H 45/12

[52] U.S. Cl. ..... 493/457; 493/458; 493/447

[58] Field of Search ..... 493/254, 449, 451, 456, 493/458, 457; 156/479, 492; 112/121.12; 2/254, 247

[56] References Cited

U.S. PATENT DOCUMENTS

| | | | |
|---|---|---|---|
| 2,245,675 | 6/1941 | Hultin | 493/254 X |
| 3,086,337 | 4/1963 | Engleson | 493/457 X |
| 4,174,988 | 11/1979 | Moore | 156/492 X |
| 4,338,086 | 7/1982 | Heater | 493/458 X |

*Primary Examiner*—A. J. Heinz

*Attorney, Agent, or Firm*—Richards, Harris & Medlock

[57] ABSTRACT

A method and apparatus for folding a piece of welt material along longitudinal and transverse fold lines. The method and apparatus produce a folded piece of welt material with sharply defined transverse and longitudinal folds in a safe and efficient manner. A preferred embodiment of the garment welt folder (26) utilizes a template (30) having a recessed area (34) and a slot (38) with sharply defined longitudinal and transverse edges corresponding to longitudinal and transverse folds to be made in the welt material (64). Finger blades (50, 52) are positioned to secure the welt material (64) at the longitudinal fold lines by a vertical double-acting fluid cylinder (44) and two horizontal double-acting fluid cylinders (46, 48). Two portions (68, 70) of the welt material (64) extending beyond the longitudinal fold line are folded over the portion (66) of the area of the welt material (64) within the longitudinal fold lines by two folding blades (58, 60). The folding blades are operated by two double-acting fluid cylinders (54, 56). Subsequently, the double-acting fluid cylinders retract the finger blades (50, 52) and then the folding blades (58, 60) leaving a longitudinally folded welt material (64). A rectangular plate (62) then drops into the slot (38) in the template (30) to form a transverse fold in a longitudinally folded welt material (64).

13 Claims, 8 Drawing Figures

GARMENT WELT FOLDER

TECHNICAL FIELD

The present invention relates in general to the construction of garments and items of clothing. More particularly, this invention concerns an apparatus and method for folding a piece of welt material along longitudinal and transverse folds.

BACKGROUND ART

In the manufacture of garments, pockets are provided as convenient means for carrying useful items, such as a wallet, a handkerchief, currency, change, keys and the like. Pockets are integrated into the garment and take the general form of a pouch open at one end for easy access to the contents.

Two basic types of pocket construction are used. In the patch-type pocket, a layer or patch of material is attached directly to the outside surface of the garment. The patch pocket is usually sewn only at the side and bottom edges so that articles can be received between the garment and pocket layers through the unsecured upper end. Patch pockets are thus easily constructed and attached to the garment, and are utilized most popularly in garments having less formal or leisure applications. In contrast to the patch-type pocket, the standard pocket is positioned on the inside of the garment. A slot in the garment permits access to the standard pocket. Consequently, the standard pocket occupies a hidden, protected location in the garment, which therefore presents a much neater, finished appearance. The standard pocket is basically constructed by forming a slit in a garment, attaching a pocket bag to the inner periphery of the slot and attaching a prefolded welt across or within the slot. The welt gives the slot a more finished appearance.

Efficient construction of a high quality standard pocket depends partially upon the production of the prefolded welts. The prefolded welts are normally produced by use of a garment welt folding machine. One such garment welt folding machine is the Koenig Model XK-80, sold by Apparel Equipment Company of Philadelphia, Pennsylvania. A garment welt folding machine enables an operator to produce the desired longitudinal and transverse folds in a precut piece of welt material by a series of manual and mechanical steps. First, a piece of welt material is manually positioned over a pressboard template. The template has a recessed area with edges corresponding to longitudinal folds to be made in the welt material and a slot corresponding to the transverse folds to be made in the welt material. The welt material is maintained in position on the template by the use of suction applied through holes in the recessed area of the template. Second, the longitudinal folds in the welt material are produced by manually rolling a cylindrical bar along the template over the portion of the welt material extending above the template at the longitudinal edges of the recess. The resulting longitudinal fold is not well-defined. In addition, this procedure is time-consuming, causes operator fatigue and is relatively unsafe for the operator. Third, the transverse folds in the welt material are produced by a plate, with a rectangular cross section corresponding to the cross section of the slot, which is mechanically lowered onto the longitudinally folded welt material.

The pressboard template does not provide a well-defined fold.

Therefore, a need has been shown for a garment welt folder which produces prefolded welts with sharply defined folds in an efficient and safe manner.

SUMMARY OF THE INVENTION

The present invention eliminates the foregoing problems by providing an automatic system which forms well-defined longitudinal folds in the welt material in a safe and efficient manner.

The automatic system comprises a template means for locating longitudinal and transverse fold lines to be made in the welt material. The template has a recessed area with sharply defined longitudinal edges corresponding to the longitudinal fold lines to be made in the welt material and a slot with well-defined edges corresponding to the transverse fold to be made in the welt material. A flat plate is hinged to the template and is operated in the vertical plane by a first double-acting fluid cylinder. A first pair of double-acting fluid cylinders is mounted on the top of a flat plate. A finger blade with well-defined edges is mounted on the end of each cylinder in the first pair of double-acting cylinders. The first pair of double-acting cylinders pushes the finger blades outwardly over the template such that the outer edges of the finger blades are positioned directly above the longitudinal edges of the recessed area. The first vertical double-acting fluid cylinder lowers the finger blades onto the welt material such that the outer edges of the finger blades secure the welt material to the longitudinal edges of the recessed area. A second pair of double-acting fluid cylinders is mounted opposite each other on the template such that each is perpendicular to a longitudinal fold line. A folding blade is mounted on the end of each cylinder in the second pair of double-acting fluid cylinders. The second pair of double-acting fluid cylinders pushes the folding blades outwardly across the template such that the portions of the welt material extending beyond the longitudinal fold lines are each folded over the portion of the welt material inside the longitudinal fold lines. Subsequently, the first pair of double-acting fluid cylinders retracts the finger blades away from the welt material. The first vertical double-acting fluid cylinder raises the finger blades above the surface of the recessed area. Next, the second pair of double-acting fluid cylinders retracts the folding blades. Finally, a rectangular plate having a rectangular cross section with sharply defined edges is positioned above the transverse slot in the template. The rectangular plate is lowered into the slot creating a transverse fold in the longitudinally folded welt material.

An extremely well-defined longitudinal fold is created by securing a welt material between the finger blades and the longitudinal edges of the recessed area at the longitudinal fold line and then forming the longitudinal folds by use of a folding blade. The definition of the fold is augmented by providing sharply defined edges on the finger blades, the longitudinal edges of the recessed area and the folding blades.

A better definition of the transverse fold is created by providing sharply defined edges on both the transverse slot and the lowermost end of the rectangular plate.

Automation of the procedure allows the operator to produce more folded welts of material with less work. Thus, productivity is increased and operator fatigue is reduced. In addition, operator safety is increased because the operator is no longer required to place his or her hands under the rectangular plate.

BRIEF DESCRIPTION OF THE DRAWINGS

A more complete understanding of the invention and its advantages will be apparent from the following Detailed Description taken in conjunction with the accompanying Drawings in which.

DETAILED DESCRIPTION

Figure 1:
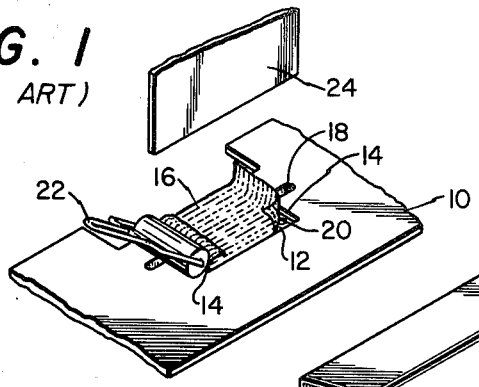
FIG. 1 (PRIOR ART)
FIG. 1 is an isometric view, partially cutaway, of the prior art.

Referring to FIG. 1, there is shown a partially cutaway view of the template area of a garment welt folder according to the prior art. A pressboard template 10 has a recessed area 12 with longitudinal edges 14 corresponding to the longitudinal fold to be made in the welt material 16 and a transverse slot 18 corresponding to the transverse folds to be made in the welt material 16. The welt material 16 is maintained in the proper orientation over the recessed area 12 by a vacuum source (not shown) applied through a plurality of holes 20 (only one hole shown) in the recessed area 12. The longitudinal folds are made in the welt material 16 by manually pushing roller 22 over the portion of the welt material 16 extending beyond the longitudinal edge 14 of recessed area 12. After each longitudinal fold has been made in the welt material 16, the rectangular plate 24 is lowered onto the longitudinally folded welt material 16 such that the cross section of rectangular plate 24 fits into slot 18. This creates the transverse fold in the material.

Figure 2:
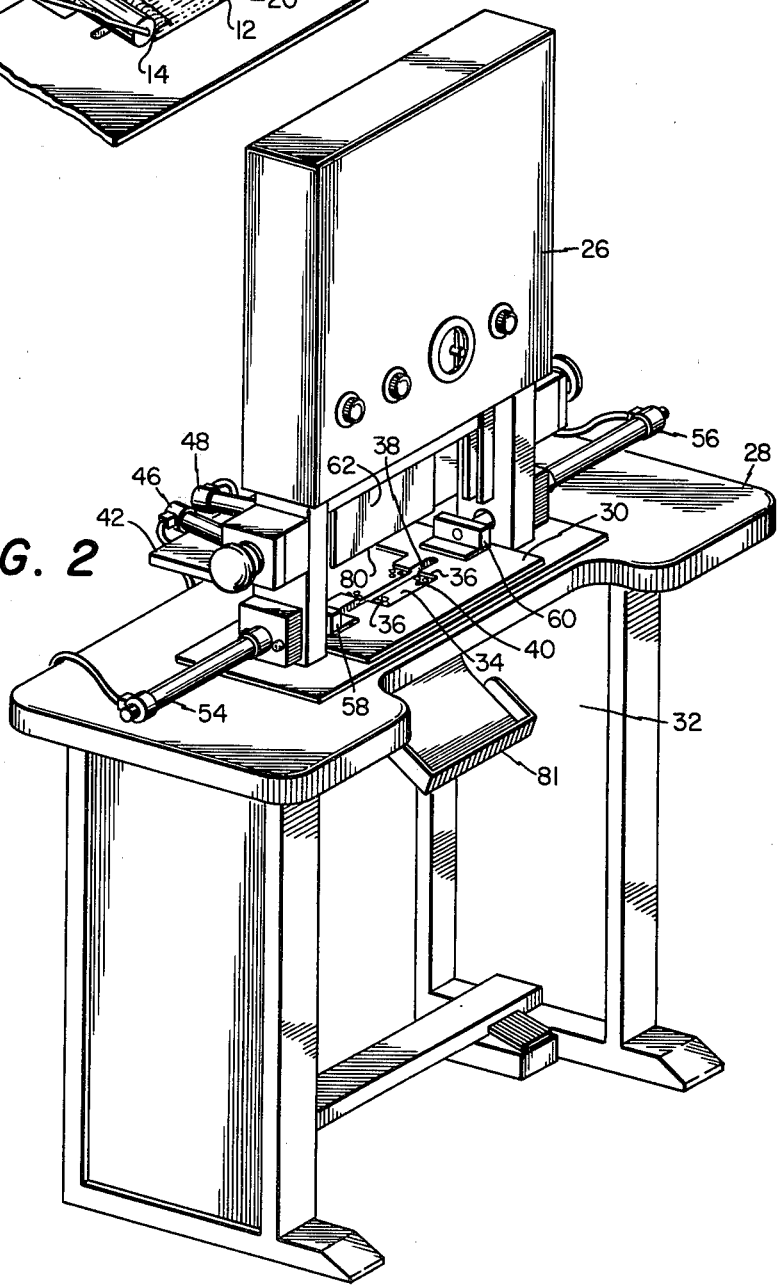
FIG. 2 is an isometric view of a garment welt folder according to the present invention.

Referring to FIG. 2, there is shown a garment welt folder 26 according to the present invention. The garment welt folder 26 basically comprises a supporting table structure 28 with a template 30 mounted thereon. The supporting table structure 28 is designed such that a person may stand or sit in the front portion 32 and operate the machine. The template 30 has a recessed area 34 with sharply defined longitudinal edges 36 corresponding to the longitudinal folds to be made in the welt material 16 (not shown in FIG. 2), a transverse slot 38 with sharply defined edges corresponding to the transverse fold to be made in the welt material 16, and a plurality of holes 40 in the recessed area 34. A suction source (not shown) applied to the plurality of holes 40 in recessed area 34 functions to maintain the welt material 16 in a proper orientation over template 30. In the preferred embodiment, the template 30 is made from stainless steel in order to provide sharply defined longitudinal edges 36 in the recessed area 34 and sharply defined transverse edges in the transverse slot 38.

Figure 3:
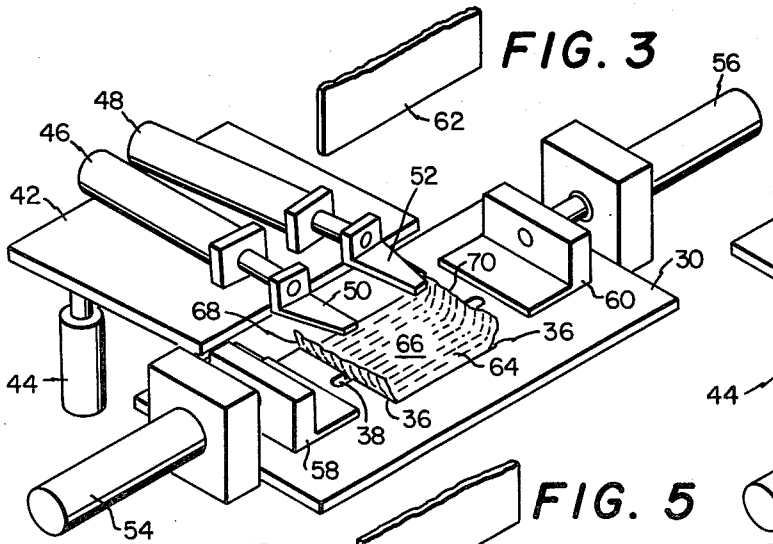
FIG. 3 is an isometric view, partially cutaway, of the garment welt folder of FIG. 2 showing the welt material in place over the template.

Referring to FIGS. 2 and 3, there is shown the flat plate 42 hinged to template 30. Flat plate 42 is operated in a vertical plane by a first double-acting fluid cylinder 44. In the preferred embodiment, double-acting fluid cylinders 46 and 48 are mounted on the top of flat plate 42. A finger blade 50 and a finger blade 52 (not shown in FIG. 2) are mounted on the end of double-acting fluid cylinders 46 and 48, respectively. In the alternative, the two double-acting fluid cylinders 46 and 48 with finger blades 50 and 52 mounted thereon, respectively, could be replaced with one double-acting fluid cylinder having one finger blade attached thereto (not shown). The outside edges of the single finger blade would correspond with the longitudinal edges 36 of the recessed area 34. Double-acting fluid cylinders 54 and 56 are mounted on opposite sides of template 30 such that double-acting fluid cylinder 54 is perpendicular to one longitudinal edge 36 of recessed area 34 and double-acting fluid cylinder 56 is perpendicular to the other longitudinal edge 36 of template 30. Folding blades 58 and 60 are mounted on the ends of double-acting fluid cylinders 54 and 56, respectively. Plate 62, with a cross section corresponding to the cross section of the slot 38, is positioned such that the cross section of plate 62 is directly above the cross section of slot 38. In the preferred embodiment, plate 62 is a rectangular plate with a rectangular cross section.

Referring to FIGS. 3 through 6, there is shown the operation of the garment welt folder 26 according to the present invention. Referring to FIG. 3, there is shown the first step in folding the welt material 64 according to the present invention. The welt material 64 is placed upon template 30 in an orientation such that the portion 66 of the area of the welt material 64 is within the longitudinal fold lines 36 and the portions 68 and 70 of the area of the welt material 64 are outside the longitudinal fold lines 36. During this step, the finger blades 50 and 52 and the folding blades 58 and 60 are positioned away from the recessed area 34 of the template 30 such that there is no interference with the placement of the welt material 64. Flat plate 42 is tilted backwards by retracting double-acting fluid cylinder 44 such that the bottom surfaces of finger blades 50 and 52 are lifted above and oriented at an angle to the top surface of the recessed area 34 of template 30. In addition, the double-acting fluid cylinders 44 and 48 are retracted such that finger blades 50 and 52 are located away from the welt material 64. The double-acting fluid cylinders 54 and 56 are also retracted such that folding blades 58 and 60 are located away from the welt material 64.

Figure 4:
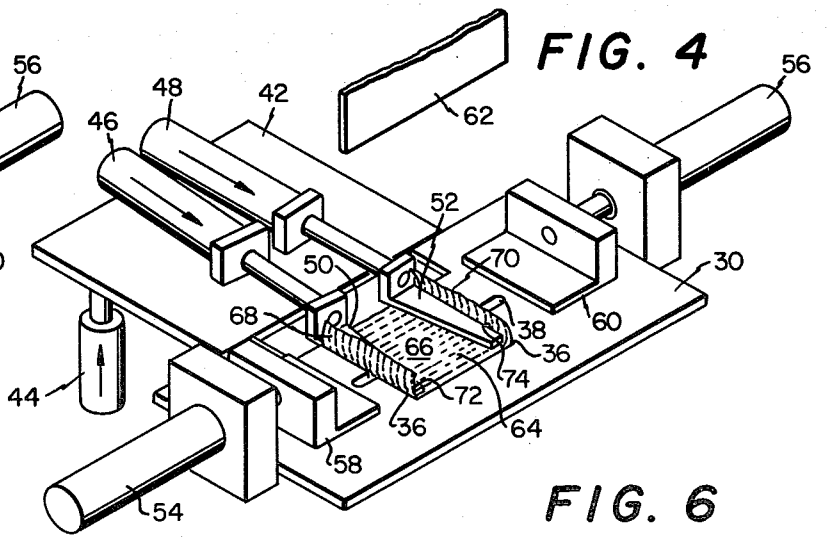
FIG. 4 is a view similar to FIG. 1, but showing the finger blades securing a welt material to the longitudinal edge of the recessed area of the template.

Referring to FIG. 4, there is shown a second step in the operation of the garment welt folder 26. Double-acting fluid cylinders 46 and 48 extend the finger blades 50 and 52 and the double-acting fluid cylinder 44 raises the back of flat plate 42 such that the outer edges 72 and 74 of finger blades 50 and 52, respectively, secure the welt material 64 against the longitudinal edges 36 of the recessed area 34 of template 30. In the preferred embodiment, the outside edges 72 and 74 of finger blades 50 and 52, respectively, have sharply defined edges. These sharply defined edges assure a well-defined fold along longitudinal edges 36. During this step, double-acting fluid cylinders 54 and 56 remain retracted such that folding blades 58 and 60 do not interfere with the operation of finger blades 50 and 52.

Figure 5:
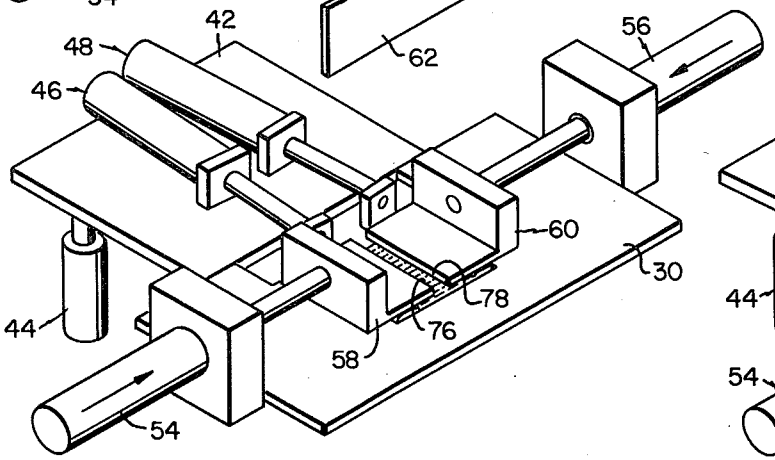
FIG. 5 is a view similar to FIG. 4, but showing the folding blades extended outwardly to create the longitudinal folds.

Referring to FIG. 5, there is shown the third step in the operation of the garment welt folder 26 according to the present invention. Double-acting fluid cylinders 54 and 56 extend folding blades 58 and 60, respectively, outward such that the portions 68 and 70 of the area of the welt material 64 outside the longitudinal fold lines 36 are each folded over the portion 66 of the area of welt material 64 inside the longitudinal fold lines 36 as the folding blades 58 and 60 move from a full retracted position away from the recessed area 34 to a fully extended position over the recessed area 34. This operation creates a permanent well-defined fold in the welt material 64 along the longitudinal edge 36. In the preferred embodiment, the outer edges 76 and 78 of the folding blades 58 and 60, respectively, are sharply defined in order to produce a more crisp fold line in the welt material 64 along the longitudinal edges 36.

Figure 6:
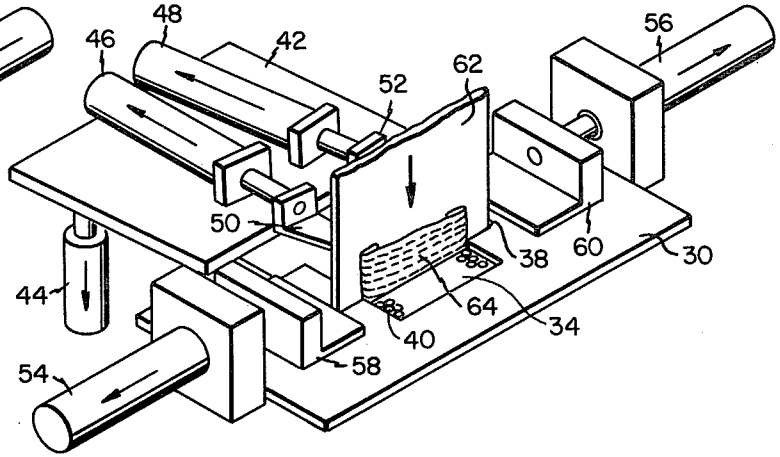
FIG. 6 is a view similar to FIG. 5, but showing the finger blades and folding blades retracted and the rectangular plate creating the transverse fold in the longitudinally folded material.

Referring to FIG. 6, there is shown the next step in the operation of the garment welt folder 26 according to the present invention. First, double-acting fluid cylinders 46 and 48 are retracted such that finger blades 50 and 52, respectively, no longer intersect any area of the welt material 64. The welt material 64 is maintained in the same position on the recessed area 34 of template 30 by the suction source (not shown) applied through the plurality of holes 40 in recessed area 34. Second, double-acting fluid cylinder 44 is retracted to tilt flat plate 42 backwardly such that finger blades 50 and 52 are lifted angularly above the recessed area 34. Third, double-acting fluid cylinders 54 and 56 retract folding blades 58 and 60, respectively, such that folding blades 58 and 60 do not cover any portion of transverse slot 38. Fourth, plate 62 is lowered into slot 38 to create the transverse fold in the longitudinally folded welt material 64. In the preferred embodiment, the bottom edge 80 (see FIG. 2) is sharply defined in order to create a crisp transverse fold line in the longitudinally folded welt material 64.

An additional step which is not illustrated in FIGS. 3–6 is the pressing and release of the longitudinally and transversely folded welt material 64. Plate 62 forces the longitudinally and transversely folded welt material 64 downward through slot 38 into a pressing mechanism (not shown) where electrically heated plates are brought together by air cylinder pressure for a predetermined period of time and then released. Upon release of the electrically heated plates, the pressed welt material 64 slides into the holding tray 81 (shown in FIG. 2). Optionally, the longitudinally and transversely folded welt material 64 may be adhered in the pressing mechanism to form a finished pocket welt. A piece of fusible adhesive material (not shown) is placed on the longitudinally folded welt material 64 before plate 62 is lowered thereon. When the longitudinally and transversely folded welt material 64 is pressed between the electrically heated plates of the pressing mechanism, the fusible adhesive is activated to bond the pressed welt material 64 into a finished welt.

Figure 7:
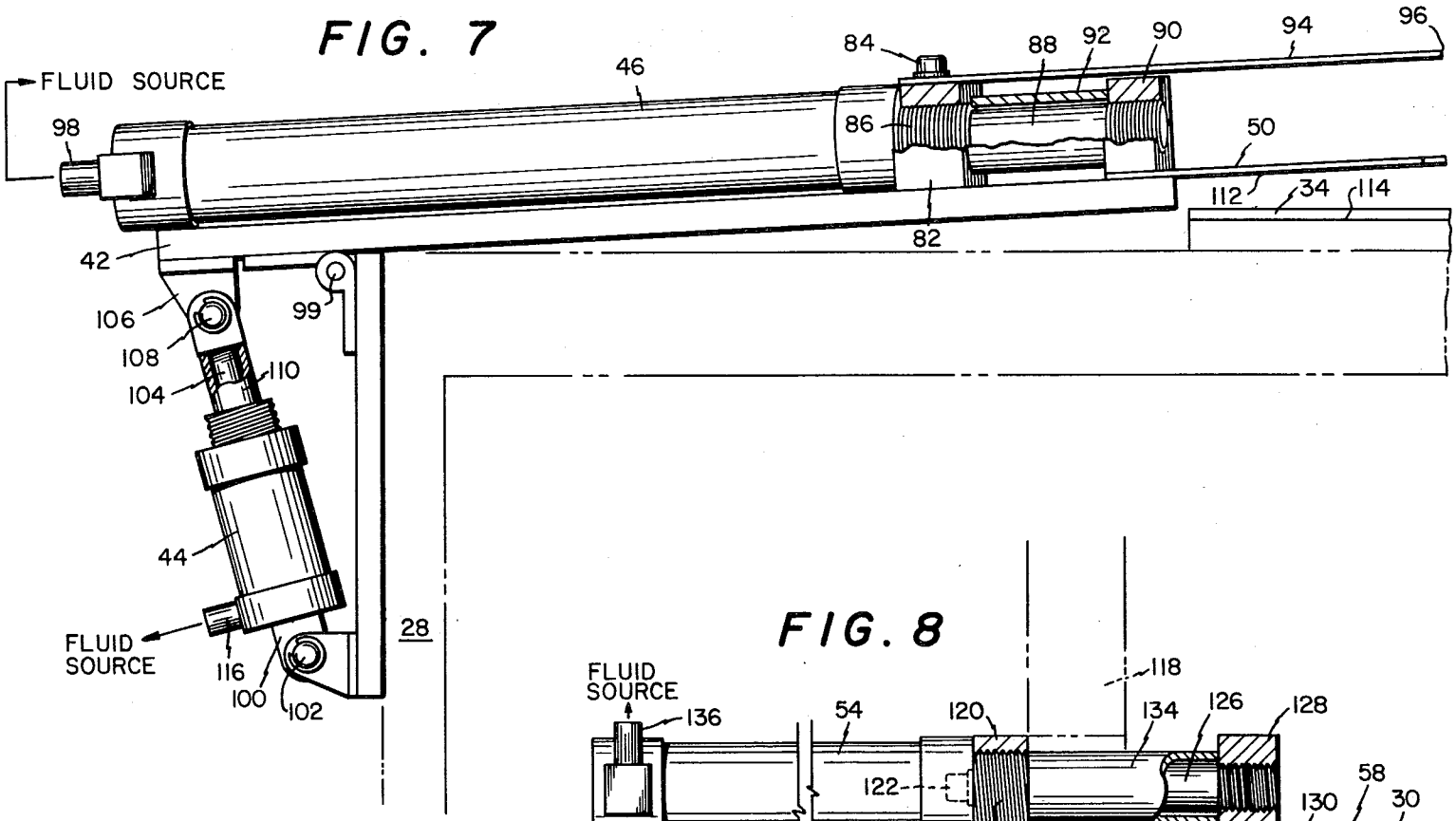
FIG. 7 is a plane view of the preferred embodiment of the apparatus for positioning the finger blades.

Now referring to FIG. 7, there is shown a detailed view of the preferred embodiment of the apparatus for placing the finger blades 50 and 52 in the desired position. Double-acting fluid cylinders 46 and 48 and corresponding finger blades 50 and 52, respectively, are substantially identical. Therefore, for the purpose of illustration, only double-acting fluid cylinder 46 and corresponding finger blade 50 are shown. Rectangular block 82 is secured to flat plate 42 by bolts 84 (only one bolt is shown). Double-acting fluid cylinder 46 is secured to flat plate 42 by screwingly attaching shaft 86 to rectangular block 82. The extending and retracting shaft 88 of double-acting fluid cylinder 46 is screwingly attached to rectangular block 90. A spacer 92 maintains the desired minimum distance between rectangular block 82 and rectangular block 90, thereby defining the maximum retraction of extending and retracting shaft 88. Guiding plate 94 is attached to the top of rectangular block 82 by bolts 84 (only one is shown) and extends outwardly over block 90 to a distance corresponding to the outermost extension of extending and retracting shaft 88. Guiding plate 94 functions to maintain finger blade 50 in an orientation substantially parallel to the surface of the recessed area 34 of the template 30 when the double-acting fluid cylinder 44 is extended such that flat plate 42 is in a horizontal position parallel to the surface of template 30. Double-acting fluid cylinder 46 is activated by a fluid source (not shown) sending fluid to the double-acting cylinder 46 through tube 98.

The flat plate 42 is hinged to the supporting table structure 28, adjacent the recessed area 34 of template 30, by hinge 99. The double-acting fluid cylinder 44 is operatively connected between the bottom of flat plate 42 and the supporting table structure 28. The base 100 of double-acting fluid cylinder 44 is connected to the table structure 28 of the garment welt folder 26 by swivel joint 102. The extending and retracting shaft 104 of double-acting fluid cylinder 44 is connected to a brace 106 on the bottom of flat plate 42 by swing joint 108. The spacer 110 mounted on the shaft 104 of double-acting fluid cylinder 44 defines the maximum retraction of shaft 104 thereby defining the maximum vertical downward or backward tilt of plate 42. The maximum vertical extension of shaft 104 is limited by the bottom surface 112 of finger blade 50 contacting the upper surface 114 of recessed area 34. Double-acting fluid cylinder 44 is operated by a fluid source connected to the double-acting fluid cylinder 44 by tube 116.

Figure 8:
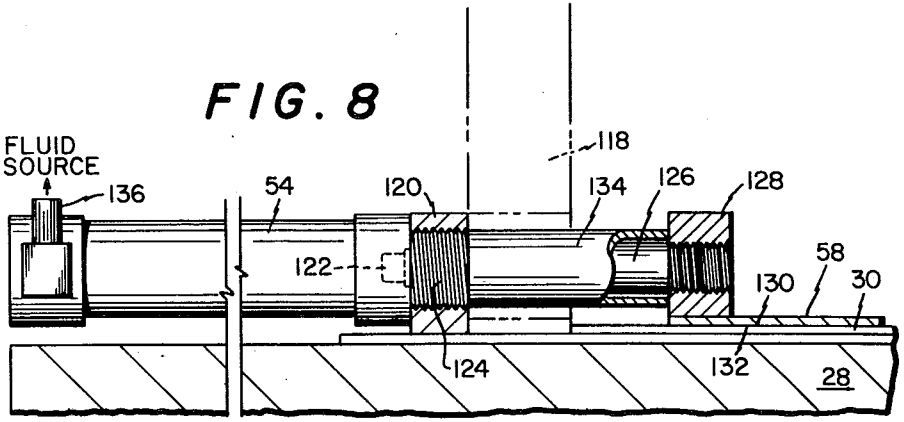
FIG. 8 is a plane view of the preferred embodiment of the double-acting cylinder and folding blade.

Referring to FIG. 8, there is a shown a detail of the preferred embodiment of the double-acting fluid cylinders 54 and 56 and the corresponding folding blades 58 and 60, respectively. Double-acting fluid cylinders 54 and 56 and corresponding folding blades 58 and 60 are substantially identical. Therefore, for the purpose of illustration, only double-acting fluid cylinder 54 and corresponding folding blade 58 are shown. Vertical member 118 is attached to the supporting table structure 28 of the garment welt folder 26. Rectangular block 120 is connected to vertical member 118 by bolts 122 (only one bolt shown). Double-acting fluid cylinder 54 is screwingly attached to block 120 by shaft 124, thereby securely attaching double-acting fluid cylinder 54 to vertical member 118. Extending and retracting shaft 126 of double-acting fluid cylinder 54 extends through vertical member 118 and is screwingly attached to rectangular block 128. Folding blade 58 is mounted on the bottom of rectangular block 128. Folding blade 58 is oriented substantially horizontal to the surface of template 30 and is maintained in this position by the close tolerance between the bottom surface 130 of folding blade 58 and the top surface 132 of template 30. Spacer 134 positioned on shaft 126 between rectangular block 120 and rectangular block 128 defines the maximum retraction of shaft 126 of double-acting fluid cylinder 54. The maximum extension of shaft 126 of double-acting fluid cylinder 54 is limited only by the length of shaft 126. Double-acting fluid cylinder 54 is operated by a fluid source connected to tube 136.

Although particular embodiments of the invention have been illustrated in the Drawings and described herein, it will be understood that the invention is not limited to such embodiments, but is capable of numerous rearrangements, modifications and variations of parts and elements without departing from the spirit of the invention.

I claim:

1. An apparatus for mechanically folding a piece of welt material along longitudinal fold lines and along transverse fold lines comprising:

(a) a template for locating at least two longitudinal fold lines which define an area therebetween and transverse fold lines in a piece of welt material such that a first portion of the welt material is inside and two portions of the welt material are outside the area defined by the longitudinal fold lines, said template having a recessed area with longitudinal edges corresponding to the longitudinal fold lines and a slot extending transversely across the recess beyond each longitudinal edge and having predetermined dimensions;

(b) finger blade means with sharply defined edges corresponding to the longitudinal edges of the recess, said finger blade means for movement into the recess in the template and thereby positively securing the welt material between the outer edge of each finger blade means and the corresponding longitudinal edge of the recess;

(c) first moving means for moving the finger blade means between a retracted position away from the recessed area in the template to an extended position where the outer edge of each finger blade means is positioned directly above the corresponding longitudinal edge of the recess;

(d) hinged means for lowering the finger blade means onto the welt material such that the outer edge of each finger blade means secures the welt material to the corresponding longitudinal edge of the recess;

(e) two folding blades for pushing the two second portions of the welt material over the first portion of the welt material along each longitudinal fold line;

(f) a second moving means for moving the folding blades between a retracted position away from the longitudinal edge of the recessed area to an extended position over the longitudinal edge of the recessed area;

(g) plate means with a cross section corresponding to the dimensions of the slot for movement into the slot and thereby forcing a portion of the welt material snugly into the slot in such a manner as to produce a transverse fold in the longitudinally folded welt of material.

2. The apparatus of claim 1, further comprising:

(a) a plurality of holes in the recessed area of the template; and (b) a vacuum source applied to the holes for maintaining the position of the welt material on the template such that the first portion of the welt material remains inside the area defined by the longitudinal fold lines.

3. The apparatus of claim 1, wherein a template is made from stainless steel such that the longitudinal edges of the recessed area and the transverse edges of the slot are sharply defined.

4. The apparatus of claim 1, wherein the finger blade means comprises two finger blades.

5. The apparatus of claim 4, wherein the first moving means comprises first and second double-acting fluid cylinders, each connected to one of the finger blades, for moving the finger blades between the retracted position and the extended position.

6. The apparatus of claim 1, wherein the finger blade means comprises one finger blade.

7. The apparatus of claim 6, wherein the first moving means comprises a first double-acting fluid cylinder connected to the finger blade for moving the finger blade between the retracted position and the extended position.

8. The apparatus of claim 1, wherein the hinged means comprises:

(a) a flat plate upon which the first moving means are mounted, said flat plate hinged adjacent to the template; and (b) a third double-acting fluid cylinder operatively connected between the flat plate and the template for moving the flat plate in the vertical plane such that the finger blade means alternately secure and release the welt material at the longitudinal fold lines.

9. An apparatus for mechanically folding a piece of welt material along longitudinal fold lines and along transverse fold lines, comprising:

(a) a template for locating at least two longitudinal fold lines which define an area therebetween and transverse fold lines to be made in the welt material such that a first portion of the welt material is inside and two second portions of the welt material are outside the area defined by the longitudinal fold lines, said template having a recessed area with longitudinal edges corresponding to the longitudinal fold lines and a slot having a substantially rectangular cross section extending transversely across the recess beyond each longitudinal edge;

(b) first and second finger blades with sharply defined longitudinal edges corresponding to the longitudinal edges of the recessed area, said first and second finger blades for movement into the recessed area and thereby securing the welt mtaterial between the longitudinal edge of the recessed area and the longitudinal edges of the finger blades;

(c) first and second double-acting fluid cylinders connected to each finger blade, for movement of the finger blades between a retracted position away from the welt material and an extended position where the longitudinal edge of each finger blade is positioned directly above the corresponding longitudinal edge of the recess;

(d) a flat plate upon which the first and second double-action fluid cylinders are mounted, said flat plate hinged adjacent the template and movable in the vertical plane;

(e) a third double-action fluid cylinder operatively connected between the flat plate and the template for moving the flat plate in the vertical plane such that the finger blades alternately secure and release the welt material at the longitudinal fold lines;

(f) first and second guiding blades for assuring the finger blades are oriented substantially parallel to the surface of the recessed area when the finger blades secure the welt material, said first and second guiding blades mounted on the second and third double-acting fluid cylinders, respectively, and extending outwardly to a distance corresponding to the outward extension of the folding blades;

(g) first and second folding blades, with sharply defined outer edges, for folding the two second portions of the welt material over the first portion of the welt material at the longitudinal fold lines;

(h) fourth and fifth double-action fluid cylinders connected to the first and second folding blades, respectively, for movement of the folding blades between the retracted position away from the recessed area and an extended position over the recessed area such that the welt material is folded along the longitudinal fold lines as the folding blades move from the retracted to the extended position;

(i) a plate with sharply defined lower edges and a substantially rectangular cross section movably mounted above the template, the substantially rectangular cross section of the plate corresponding to the substantially rectangular cross section of the slot extending transversely across the recess; and (j) a means for moving the plate between a retracted position above the recessed area to an extended position, where the lower end of the plate is in the slot, such that a transverse fold is created.

10. The apparatus of claim 9, further comprising:

(a) a plurality of holes in the recessed area of the template; and (b) a vacuum source applied to the holes in the recessed area for maintaining the position of the welt material on the template such that the first portion of the welt material remains inside the area defined by the longitudinal fold lines.

11. A method for folding a piece of welt material along longitudinal fold lines and along transverse fold lines, comprising the steps of:

(a) positioning a piece of welt material on a template having a recessed area with longitudinal edges corresponding to at least two longitudinal fold lines to be made in the welt material, and which define an area therebetween such that a first portion of the area of the welt material is inside and two second portions of the area of the welt material are outside the area defined by the longitudinal fold lines;

(b) extending a pair of finger blades each having a longitudinal edge corresponding to a longitudinal edge of the recess of the template outwardly over the welt material such that the longitudinal edge of each finger blade is positioned directly above the corresponding longitudinal edge of the recess;

(c) lowering the pair of finger blades onto the welt material such that the welt material is secured between the longitudinal edges of the finger blades and the longitudinal edges of the recessed area at the longitudinal fold lines;

(d) extending a pair of folding blades outwardly from a retracted position away from the longitudinal edge of the recessed area to an extended position over the longitudinal edge of the recessed area, such that the two second portions of the area of the welt material are folded over the first portion of the area of the welt material at each longitudinal fold line;

(e) retracting the pair of finger blades to a position away from the welt material such that the finger blades no longer secure the welt material between the longitudinal edges of finger blades and the longitudinal edges of the recessed area;

(f) raising the pair of finger blades above the surface of the recessed area;

(g) retracting the pair of folding blades from the extended to the retracted position;

(h) lowering a plate having a cross section corresponding to the cross section of a slot formed in the template and extending at least between the longitudinal edges of the recess therein into the slot and thereby forming the transverse fold in the longitudinally folded welt material; and (i) raising the plate above the welt material.

12. The method of claim 11, wherein the step of lowering the pair of finger blades onto the welt material further comprises the step of assuring that the surface of the pair of finger blades is substantially parallel to the surface of the recessed area when the pair of finger blades secures the welt material.

13. The method of claim 11, comprising the further step of maintaining the welt material in position on the recessed area in the template such that the first portion of the welt material remains inside the area defined by the longitudinal fold lines.

* * * * *